United States Patent [19]

Davis, Jr.

[11] 4,073,564

[45] * Feb. 14, 1978

[54] CHRISTMAS TREE SERIES LIGHT STRING

[76] Inventor: George B. Davis, Jr., 7512 Marbury Road, Bethesda, Md. 20034

[ * ] Notice: The portion of the term of this patent subsequent to Feb. 1, 1994, has been disclaimed.

[21] Appl. No.: 767,881

[22] Filed: Feb. 11, 1977

Related U.S. Application Data

[63] Continuation-in-part of Ser. No. 751,089, Dec. 16, 1976.

[51] Int. Cl.[2] ..... H01R 11/02

[52] U.S. Cl. ..... 339/157 C; 339/63 R

[58] Field of Search ..... 339/28, 29, 63 R, 63 M, 339/154 R, 154 A, 154 L, 156 R, 156 T, 157 R, 157 C, 196 R, 196 M, 196 A, 198 H, 206 R, 206 P; 240/10 T

[56] References Cited

U.S. PATENT DOCUMENTS

| | | | |
|---|---|---|---|
| 2,071,948 | 2/1937 | Peters | 339/157 C |
| 3,344,392 | 9/1967 | Briscoe | 339/28 |
| 3,874,762 | 4/1975 | Shott et al. | 339/196 R |
| 4,005,923 | 2/1977 | Davis, Jr. | 339/157 C |

*Primary Examiner*—Neil Abrams

[57] ABSTRACT

This invention relates generally to Christmas tree lighting and particularly to a series string of Christmas tree lights wherein the series loop may be temporarily opened by separating the plug connector to permit untangling of the string and thereafter the loop restored for operatively connecting with a power source by again plugging together the halves of the connector.

5 Claims, 4 Drawing Figures

FIG. 1
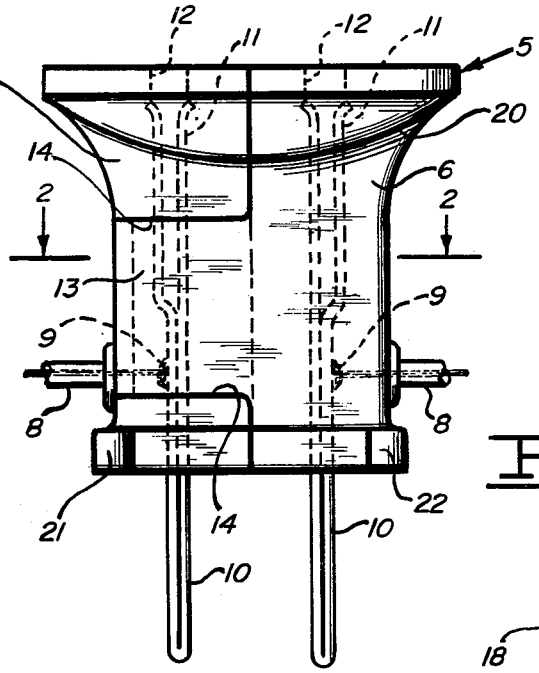
FIG. 3
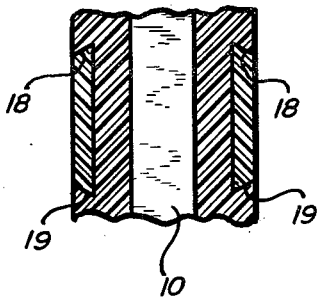
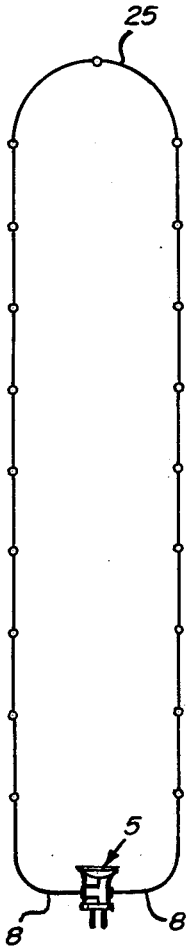
FIG. 4
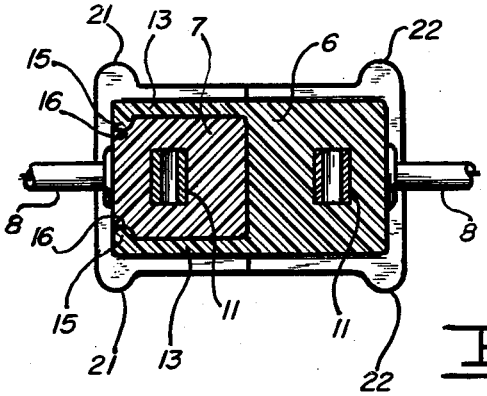
FIG. 2

CHRISTMAS TREE SERIES LIGHT STRING

This application is a continuation in part of pending application Ser. No. 751,089 filed Dec. 16, 1976.

It is an object of the present invention to provide for opening a series connected lighting loop by separating the connector plug of the loop.

A further object is to enable a lighting series loop to be opened to more easily arrange the lights upon a tree and whereupon after the lamps are substantially in place and the loop connected and lighted, the final positioning of the lamps may be more readily effected.

A still further object is to enable the series loop of a Christmas tree lighting string to be opened while the string is still upon the tree to permit the string to be quickly and easily removed from the tree without tangling with other strings upon the tree.

A further object is to provide a connector plug for a series string of Christmas tree lights that has a bright and different color from the wire of the series thusly to enable the free ends of the string, after the plug has been separated, to be more readily detected and thereby to more effectively facilitate an untangling operation.

Another object is to enable the loop of a lighting series to be opened to form an inline string which is more easily wound upon a cardboard or rolled paper support for storage and thereafter unwound for use without the tangling hazard generally accompanying the storing of lighting series of this type.

To better understand the advantages of the present invention, reference is now made to the accompanying drawing wherein:

FIG. 1 is a side view in elevation of the plug connector of the lighting series of FIG. 4.

FIG. 2 is a view in cross-section as taken along 1—1 of FIG 1.

FIG. 3 is a fragmentary cross-section showing an alternate structure for the locking arms that secure the halves of the connector together.

FIG. 4 is a view of a lighting series as including the connector plug of the device.

Referring now to the drawings and more particularly to FIG. 1 thereof, wherein is shown the connector plug 5 of the lighting series of FIG. 4 and wherein the two halves of the plug are shown as assembled together to form what appears to be a conventional plug connector for connecting the lighting series 25 to a conventional power supply outlet.

Here the connector halves 6 and 7 are shown as moldings over the respective ends of the series loop and into which the wires 8 of the series extend to connect with the terminal prongs of the connector as at 9. These terminals are of the conventional through type with the projecting portion 10 thereof closed for extending into and connecting with a conventional power supply outlet with the open end 11 within the body of the connector positioned for receiving, through openings 12, the prongs of a similar type plug connector.

Formed preferably as integral molded extensions from the connector half 6, are arm like projections 13 that are so configerated and positioned as to extend around in releasibly locking engagement with similarily formed recesses 14 provided therefor within the other half of the connector and as shown to advantage in FIG. 2. These arms 13 desirably include a somewhat enlarged end portion 15 which serves to engage and lock with similar formed depressions 16 provided within each of the recesses 14 and by means of which the halves of the plug connector are thereby secured together during normal use of the device. The material of the connector is preferably of one of the many forms of semi-hard plastics which will yeild sufficiently as to allow the ready coupling of the halves of the connector together.

While arms 13 herein shown as integral molded portions of the connector half 6 these extending members may be otherwise formed or as shown in FIG. 3, to telescope into and be maintained frictionally within the other half of the connector by reason of their dovetailed configerated surfaces 18 and 19. The primary requirement, structure and arrangement of the interlocking members being that with the connector halves assembled together, the halves of the connector cannot be seperated until the connector has been removed from a power supply outlet.

Desirably, the molded halves are so formed as to include the surfaces 20 which serves to assist withdrawing the plug from a supply outlet while the extending portions 21 and 22 thereof, assist in gripping the plug halves to assist in separating the plug.

In operation, the series loop 25 would normally come with the plug assembled as shown in FIG. 4 and whereupon the string may be conventionally arranged upon a tree to be lighted, however,when removing the string and where several strings may be overlapping in their placement upon the tree, such a plus is highly desirable in that it allows a series loop to be opened and the plug halves threaded through the other strings upon the tree as required to quickly separate each string without the usual tangle and bother.

A further advantage of the present device is the ease with which a snarled string or strings may be untangled. The plug is simply separated and the now free ends of the series loop are drawn through the tangled strings as required to quickly extract the string and eliminate the tangle. Generally the untangling of two or more 35 or 50 light strings can become an almost insurmountable task and which usually requires cutting and splicing the strings or totally discarding strings as is frequently the case.

While herein is shown one simple form of the invention that has proven satisfactory, it is understood that various modifications may be made therein for seperating and securing the halves of connectors together without departing from the spirit and scope of the device as herein shown.

I claim:

1. A two prong electrical connector for connecting electrical apparatus to a two conductor electrical outlet comprising, on insulating housing of two seperatable halves, a terminal prong mounted in and extending respectively from each half of said housing and to which may be electrically connected said apparatus and with the longitudinal axis of said terminal prongs positioned substantially parellel with each other when said connector halves are secured together, means forming at least one pair of arms extending form one half of said housing, arm receiving surfaces formed in the other half of said housing and with said arms and arm receiving surfaces positioned to engage and releasably secure said connector halves together by movement of said connector halves together in a direction substantually transverse to the longitudinal axis of said terminal prongs and to prevent seperation of said connector halves except by movement of said connector halves apart along a plane lying substantially transverse to the longitudinal axis of said terminal prongs.

2. An electrical connector as claimed in 1 wherein said apparatus is an string of series connected ornamental lights of which the terminal ends of said series are respectively connected to the terminal prongs of said connector.

3. An electrical connector as claimed in claim 2 wherein the connector halves are formed as moldings about the respective terminal ends of said series.

4. An electrical connector as claimed in claim 1 wherein said arms and arm receiving surfaces includes means for releasably locking the said connector halves together.

5. An electrical connector as claimed in claim 1 wherein each half of the said housing includes respective recesses into which may be inserted the terminal prongs of a similar type connector for respectively engaging electrically a poriton of the said terminal prongs within said connector halves.

* * * * *